United States Patent [19]

Schrader

[11] 4,238,932

[45] Dec. 16, 1980

[54] HIGH PRESSURE CHARGE STORAGE SYSTEM

[75] Inventor: Paul D. Schrader, Louisville, Ky.

[73] Assignee: General Electric Company, Louisville, Ky.

[21] Appl. No.: 59,714

[22] Filed: Jul. 23, 1979

[51] Int. Cl.[3] ..... F25B 41/00

[52] U.S. Cl. ..... 62/197; 62/513

[58] Field of Search ..... 62/197, 503, 513, DIG. 17, 62/113

[56] References Cited

U.S. PATENT DOCUMENTS

| | | | |
|---|---|---|---|
| 3,014,351 | 12/1961 | Leimbach | 62/197 |
| 3,014,352 | 12/1961 | Leimbach | 62/197 |
| 3,636,723 | 1/1972 | Kramer | 62/197 |
| 3,807,192 | 4/1974 | Portor | 62/197 |
| 3,872,687 | 3/1975 | Bottum et al. | 62/503 |

*Primary Examiner*—Ronald C. Capossela

*Attorney, Agent, or Firm*—Frank P. Giacalone; Radford M. Reams

[57] ABSTRACT

A refrigeration system of the type for conditioning the air within an enclosure and is more particularly concerned with a system comprising flow control means for controlling the flow of refrigerant through the system. The system incorporates charge modulating means for regulating the effective circulating charge of the refrigerant under various operating conditions, including high discharge pressure relief flow control means operable at predetermined high pressure to conduct high pressure liquid refrigerant through the charge modulating means.

3 Claims, 1 Drawing Figure

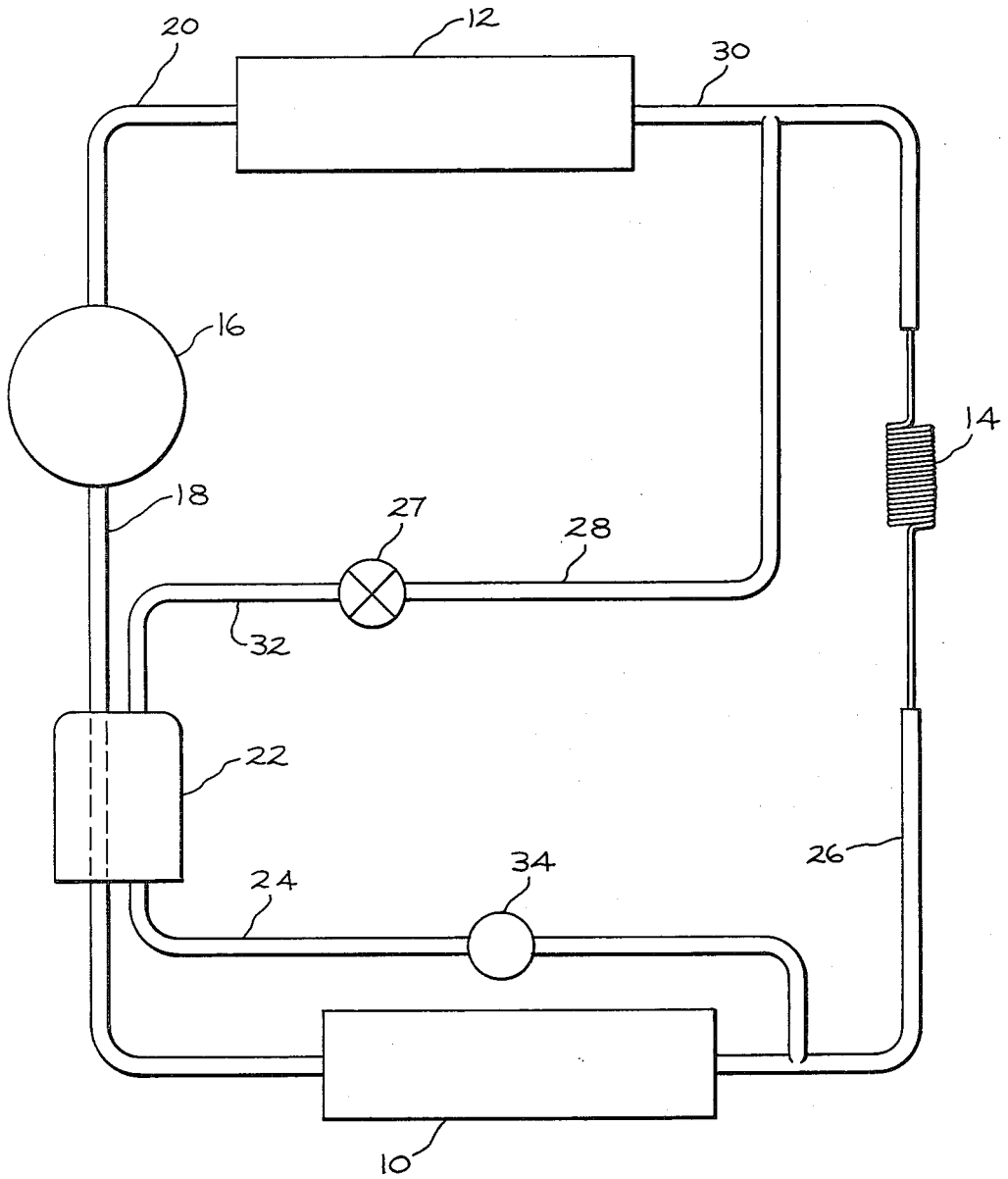
20
12
30
16
14
18
27
28
32
22
26
24
34
10

HIGH PRESSURE CHARGE STORAGE SYSTEM

BACKGROUND OF THE INVENTION

A refrigeration system of the type used for cooling the air within an enclosure comprises a refrigerant circuit including in-closed series connection, a condenser, flow restricting means, an evaporator and a compressor. The compressor withdraws low pressure refrigerant vapor from the evaporator and discharges high pressure refrigerant to the condenser. A flow restrictor, generally known as a capillary tube, provides a simple and low-cost means for controlling or restricting the refrigerant flow so as to maintain a pressure difference between the condenser and evaporator. However, since a capillary tube provides a substantially fixed-flow restriction, it has only one ideal operating condition. In effect, a simple refrigerant circuit, including a capillary tube restrictor, will operate with maximum efficiency within a relatively narrow range of temperatures and pressures determined by the system design and refrigerant charge. In order to provide a more efficient operation of a refrigeration system under a wide range of operating conditions, it is desirable to provide means for modifying or changing the circulating refrigerant charge, depending upon the operating conditions. One means for accomplishing this comprises a dead-end storage receptacle which is heat exchanged with a portion of the refrigerant circuit between the evaporator and the compressor and which is connected by a two-way flow connection to a portion of the refrigerant circuit which operates at substantially the same pressure as the evaporator. Refrigerant is withdrawn from or added to the circuit by a modulating means in accordance with changes in system pressure and temperature conditions of the portions of the system with which the receptacle is associated.

While the use of modulating and storage means has been effective in controlling system efficiency, this does not solve the problem of compressor overload. When ambient temperatures surrounding the condenser and evaporator increase in a cooling system, the power consumption and bearing load increase because of an increase both in evaporator pressure and of condenser pressure.

One attempt at solving the problem of compressor overload is disclosed in U.S. Pat. No. 3,014,352-Leimbach. In this teaching, when the head pressure exceeds a predetermined amount, a valve tends to open and, upon sufficient head pressure increase, the valve opens completely, thus allowing refrigerant to flow from the high pressure liquid line directly into the suction line, by-passing the evaporator.

SUMMARY OF THE INVENTION

It is an object of the present invention to provide a compressor high-discharge pressure relief control device that regulates and limits the refrigerant pressure load imposed on the compressor. The high-discharge pressure relief system includes conduit having a pressure responsive valve that is designed to open at a predetermined high pressure. The valve and conduit are employed in a system that includes a modulating storage volume arranged in heat exchange relation with the suction line. Refrigerant is modululated from the system from a point upstream of the evaporator, depending on the pressure and temperature of the suction line. More particularly, the present valve is arranged in a conduit connected at one end in the condenser liquid discharge line at a point intermediate the condenser outlet and the sytem expansion device with its other end connected in flow relationship with the storage volume or accumulator. Upon sensing a predetermined high pressure at the condenser outlet which would cause a compressor overload in terms of bearings and efficiency, the valve opens thereby diverting high pressure relatively warm liquid refrigerant into the storage volume. As this relatively warm liquid refrigerant enters the storage volume which is in heat exchange relation with the relatively cold suction line, it is driven back into the system upstream of the evaporator. The amount returned to the system depends on temperature and pressure differences between the refrigerant in the storage volume and that of the suction line.

BRIEF DESCRIPTION OF THE DRAWING

The single FIGURE of the drawing shows schematically a refrigeration system embodying the invention.

DESCRIPTION OF THE PREFERRED EMBODIMENT

With reference now to the drawing, the illustrated embodiment of the invention comprises an evaporator 10, a condenser 12 and a fixed flow restricting means in the form of a capillary tube 14 connecting the condenser 12 and evaporator 10. A compressor 16 withdraws low pressure or vaporized refrigerant from the evaporator 10 through a suction line 18 and discharges hot compressed or high pressure refrigerant to the condenser 12 through a discharge line 20. Thus, the compressor 16, discharge line 20, capillary tube 14, condenser 12, evaporator 10 and suction line 18 are connected in series to form a closed refrigerant circuit in which the capillary tube 14 dividing the system high and low pressure sides provides fixed means for controlling the flow of refrigerant from the condenser 12 to the evaporator 10 to provide the desired pressure differential between these two heat exchangers. It will be understood that, in the usual air conditioning application of such a refrigerating system, fan means (not shown) are provided for, respectively circulating air from an enclosure over the evaporator 10 and outdoor air over the condenser 12.

As has been previously indicated, in any refrigerant circuit, including a fixed or capillary tube flow restricting means, there is an optimum circulating charge for most efficient operation of the system under any particular set of operating conditions. For the prupose of modifying or changing the circulating refrigerant charge in order to provide the most efficient operation of the refrigeration system under a range of operating conditions, the system also includes charge modulating means in the form of a storage volume or receptacle 22 which, as illustrated, is in heat exchange relationship with a portion of the suction line 18.

The storage volume 22 is directly connected by a two-way flow connection or conduit 24 to a portion of the low pressure side of the circuit, preferably the conduit 24 is connected in conduit 26 connecting the capillary tube 14 and the evaporator 10.

When the compressor 16 is operating, the temperature of the volume 22 follows the temperature of the low pressure refrigerant returning to the compressor through the suction line 18 so that refrigerant is withdrawn from or returned to the system through the conduit 24, depending upon the temperature of the refrigerant flowing through line 18. This withdrawal from or addition to the circuit of refrigerant is also influenced by the particular system pressure and temperature conditions in the low pressure portion of the system, such as the conduit 26, to which the two-way flow conduit 24 is directly connected.

In other words, the storage volume 22 holds a constant superheat which, in the illustrated embodiment of the invention, is equal to the pressure drop through the evaporator 10. It maintains this constant superheat, either by adding or removing charge from the main refrigerant circuit depending, as previously stated, on the system conditions, including the temperatures of the refrigerant flowing through the suction line 18 and the pressure conditions in that portion of the system represented by conduit 26.

The above-described modulating system is responsive to evaporator conditions and effective in maintaining the evaporator within design parameters relative to pressure and temperature. The modulating system thus far described is not responsive to excessive condenser head pressures that, if not reduced, can lead to compressor failure. These excessive high side pressures, when present, may result from lack of air passing through the condensers as in the case of fan motor failure, extremely dirty or clogged heat exchanger or in extreme ambient temperature conditions. In these instances, the condition causing the extreme high pressure must be corrected or, alternatively, the system shut down to prevent excessive use of energy or ultimate compressor damage and failure.

In accordance with the present invention, a high pressure relief control system is arranged in the refrigeration system in order to limit the load on the compressor.

The high pressure relief control system includes a one-way flow valve 27. A line 28 connects the inlet of valve 27 to the high pressure liquid line 30 connecting the condenser outlet to the expansion device 14, while a line 32 connects the outlet of valve 27 to the storage volume 22. The valve 27 is normally closed and opens only when the high side head pressure exceeds a predetermined amount that, if allowed to continue, would be detrimental to the system compressor. When the valve 27 opens upon a predetermined high head pressure increase, it allows pressure relief by causing refrigerant flow from the high pressure line 30 directly into the storage volume 22.

The refrigerant in the storage volume will modulate, as described above, to balance the system. Since the liquid refrigerant entering volume 22 through valve 27 is from the high side of the system, means are provided in the modulating line 24 to control the rate of refrigerant flow to line 26. Accordingly, a flow control or restrictor 34 is arranged in line 24 that allows a slow controlled flow of refrigerant to the low side portion of the system upstream of the evaporator 10 and, accordingly, prevents evaporator flooding by the high pressure liquid refrigerant when it enters the storage volume 22. It should be noted that the flow restrictor 34 must be responsive to flow in either direction since it must allow low pressure refrigerant to flow into the volume 22 as described above.

The modulating system operates as described above relative to refrigerant that is present in the storage volume. The refrigerant will be returned to the system as a function of suction pressure and temperature to maintain the refrigeration system in balance, both as to evaporator function and high side compressor head pressure.

It should be apparent to those skilled in the art that the embodiment described heretofore is considered to be presently preferred form of this invention. In accordance with the Patent Statutes, changes may be made in the disclosed apparatus and the manner in which it is used without actually departing from the true spirit and scope of this invention.

I claim:

1. In a refrigeration system including a compressor, condenser, an expansion device dividing said system between high and low pressure sides, an evaporator, and a suction line in series connected to form a closed refrigerant circuit, a refrigerant control means comprising:

a storage volume in heat exchange relation with said suction line, including first and second openings, means defining a low-pressure conduit communicating with said first opening and the low side of said refrigeration system at a point intermediate said expansion device and the inlet of said evaporator, means defining a high pressure conduit communicating with said second opening and the high side of said refrigeration system at a point intermediate the outlet of said condenser and said expansion device, pressure-responsive one-way valve means in said high pressure conduit being operable for permitting high-pressure liquid refrigerant flow into said storage volume when a predetermined high pressure is sensed to maintain said high pressure side of said system below said predetermined high pressure by returning said refrigerant to said system through said low pressure conduit.

2. The refrigeration system recited in claim 1 wherein a flow control means is arranged in said low pressure conduit for controlling the flow of high pressure refrigerant through said low pressure conduit to prevent flooding of said evaporator.

3. The refrigeration system recited in claim 2 wherein said flow control means is of the two-way type for allowing refrigerant flow through said low pressure conduit in either direction between said storage volume and said refrigerant system low side.

* * * * *